US006279195B1

(12) United States Patent
Biggs

(10) Patent No.: US 6,279,195 B1
(45) Date of Patent: Aug. 28, 2001

(54) ERGONOMIC MOP BUCKET METHOD AND APPARATUS

(76) Inventor: Blyth S. Biggs, 18 Brown Dr. Unit #1, Gardnerville, NV (US) 89706

( * ) Notice: Subject to any disclaimer, the term of this patent is extended or adjusted under 35 U.S.C. 154(b) by 0 days.

(21) Appl. No.: 09/350,402

(22) Filed: Jul. 8, 1999

(51) Int. Cl.[7] ..... A47L 13/14; A47L 13/59

(52) U.S. Cl. ..... 15/261; 15/264; 15/260; 210/455; 220/501; 220/532

(58) Field of Search ..... 15/260, 261, 262, 15/264, 263; 210/455, 251; 220/501, 532

(56) References Cited

U.S. PATENT DOCUMENTS 1,184,543 * 5/1916 Lepak ..... 15/261
1,234,721 * 7/1917 Boggess ..... 15/261
1,486,284 * 3/1924 Eiffe ..... 15/261
3,630,369 * 12/1971 Nichols ..... 15/264
3,699,606 * 10/1972 Ribas ..... 15/261
4,161,799 * 7/1979 Sorrells ..... 15/260
4,344,201 * 8/1982 Trisolini ..... 15/260
4,798,307 * 1/1989 Evrard ..... 15/264
6,000,094 * 12/1999 Young ..... 15/260

* cited by examiner

*Primary Examiner*—Gary K. Graham
(74) *Attorney, Agent, or Firm*—Herbert C. Schulze

(57) ABSTRACT

An ergonomically friendly mop bucket with wringer and method of wringing mops and conserving mop fluids including a foot operated wringer, a filter, wheel brakes and assistive drain and dumping arrangements.

1 Claim, 2 Drawing Sheets

FIG. 1
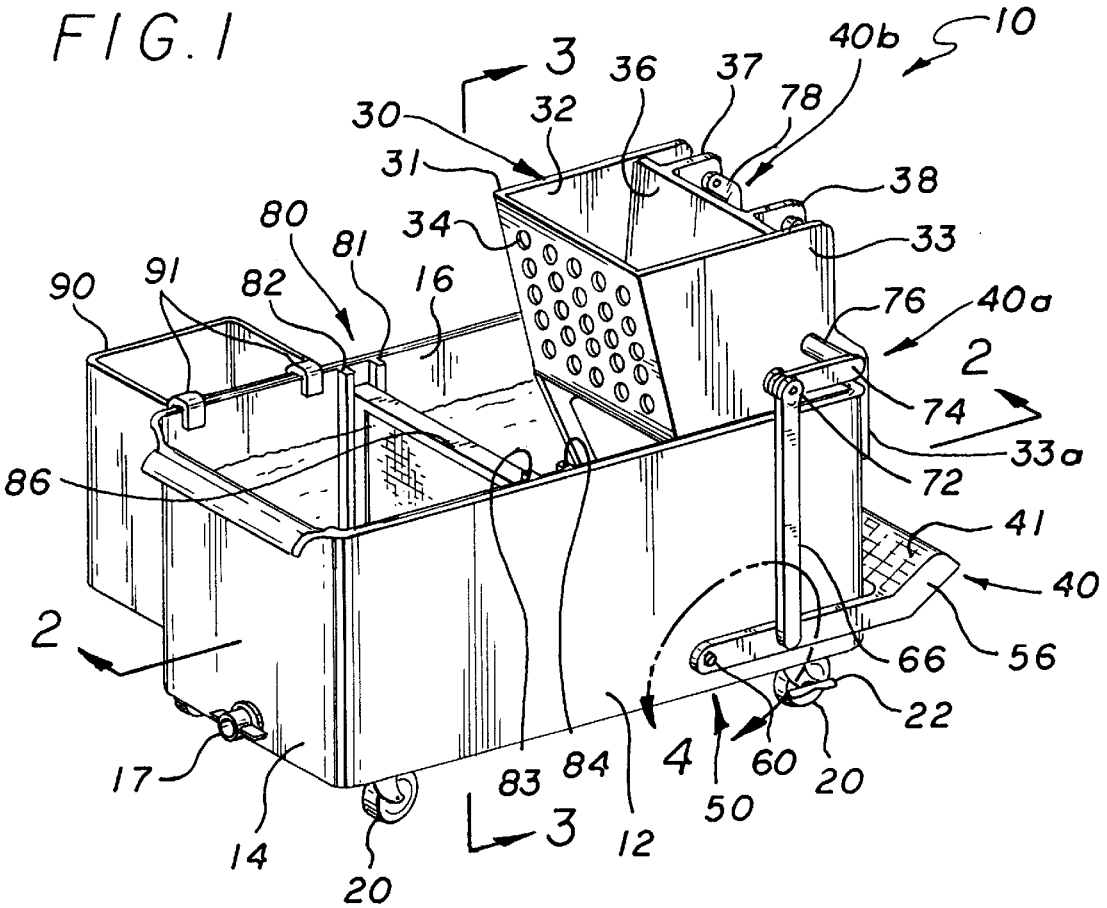
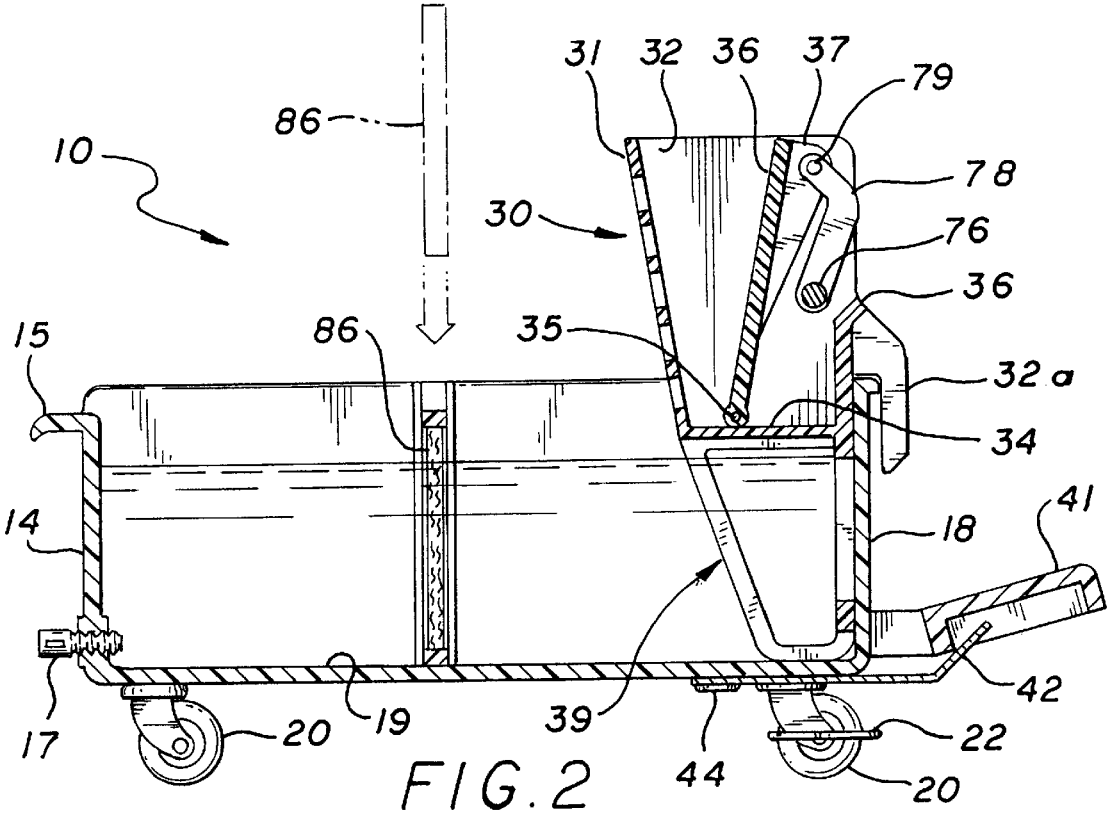
FIG. 2

FIG. 4
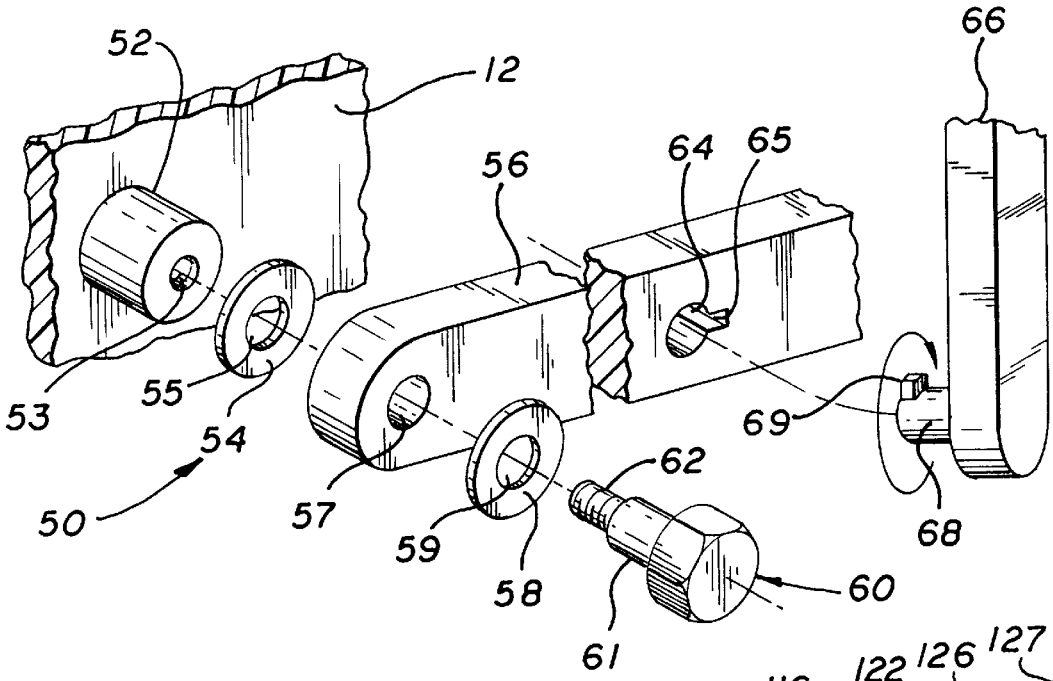
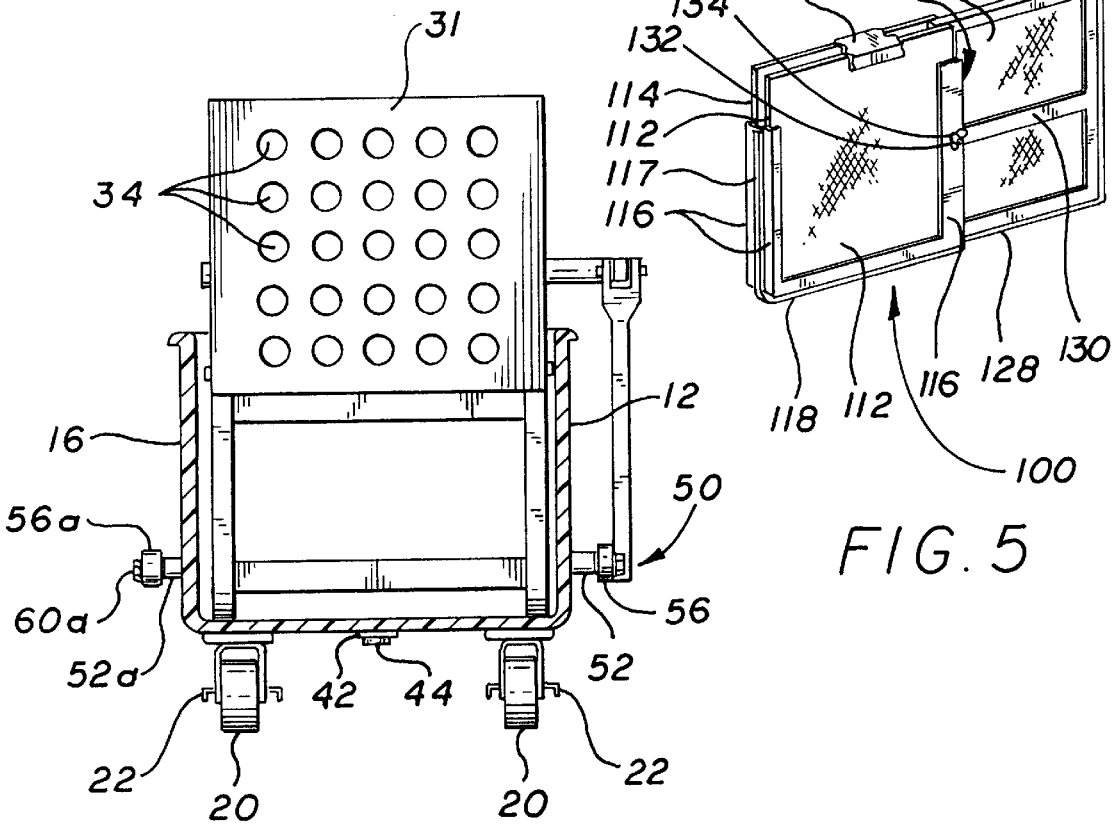
FIG. 5
FIG. 3

ERGONOMIC MOP BUCKET METHOD AND APPARATUS

CROSS REFERENCE TO RELATED PATENT APPLICATIONS

This invention is not related to any other pending application filed by me, but it is in the general field of mopping and thus is in the same very broad field as applications Ser. No. 09/290,360. Filed Apr. 12, 1999; Ser. No. 09/073,0i6, filed May 4, 1998; and Ser. No. 29/087,644, filed May 4, 1998 of which I am a co-inventor.

BACKGROUND OF THE INVENTION

I. Field of the Invention

This invention is in the general field of mopping floors, decks, and the like;

This invention is more particularly in the field of mop buckets;

This invention is even more particularly in the field of mop buckets designed to relieve stress and fatigue and the danger of injury to the user;

This invention is most particularly in the fields above mentioned and in the field of a mop bucket utilizing ergonomic procedures and means to relieve the stress and strain of wringing out mops, dumping out dirty mopping fluids, filtering fluids and securing the bucket against slippage when being used.

II. Description of the Prior Art

Mop buckets are in wide use, since mopping is prevalent throughout the world. All mop buckets share the common characteristic that they consist of a tub for holding mopping fluids and preferably have an associated means by which the mop can be wrung out so as to rid the mop of dirty fluids periodically during mopping.

The mop bucket of this invention is completely different from the prior art. This invention is a mop bucket with unique wringing means actuated by foot in order to relieve the repetitive arm, hand and body motions of wringing heretofore employed. Also, prior to my present invention mop buckets were difficult to empty, again requiring excessive repetitive hand, arm and body motions. My new mop bucket thus becomes an ergonomically beneficial item as well as an item for conserving mopping fluids and employing safety measures for the user.

I do not know of any mop bucket with the unique features of this invention as claimed below.

SUMMARY OF THE INVENTION

A mop is one of the most widely used of all implements. Going into a super market, one will see a clerk mopping a spill; Going onto a deck, one will see a mop being used; Staying in a hotel, one will see a mop; In the average home, one will see a mop; Mops literally pervade every aspect of civilized (and even uncivilized) life.

Along with mops there must be some source of water or other appropriate fluid to use with the mop. There must also be a means to clean the mop from time to time to keep the fluid fresh. Failure to do this does not result in effective mopping, since dirty fluid merely adds to the accumulation of dirt on the floor being mopped.

Most commonly, particularly in industrial mopping, a bucket will be used with the mop and some sort of wringer will be used to wring out the mop from time to time. The wringer is anything from a person's hands to hand operated mop squeezing devices The dirty fluid from the mopping will accumulates in the bucket and from time to time the person mopping will be required to dump the dirty fluid from the bucket into an appropriate sink or other drain arrangement. This is clumsy, requiring considerable strength and repetitive hand, arm, and body motion. Also, it requires frequent replenishing of the fluid supply.

Another problem is that the bucket is frequently mounted on wheels. During the wringing of the mop the bucket can roll about causing additional stress for the person doing the wringing and also causing the risk of accident by slipping and falling while trying to control the mop and bucket during wringing.

I have solved many of the problems associated with mop buckets and mopping by my new invention. I have accomplished this primarily by: providing a foot operated wringer to eliminate the repetitive hand, arm, and body motions involved with customary hand operated wringers; providing a means to filter dirty mopping fluids; providing braking means for bucket wheels; providing drain and dumping assistive methods and means; and providing other features of the invention as recited below.

It is an object of this invention to provide ergonomically friendly mop wringing methods and apparatus;

Another object of this invention is to provide assistive drain devices for mop buckets;

Another object of this invention is to provide for saving of mopping fluids and reduction of fluid replenishing cycles by special filtering methods;

Another object is to provide safety braking means on mop bucket wheels.

The foregoing and other objects and advantages of this invention will be apparent to those skilled in the art upon reading the following description of preferred embodiments in conjunction with a review of the appended drawings.

BRIEF DESCRIPTION OF THE DRAWINGS

FIG. 1 is a schematic perspective of a mop bucket suitable to practice the method of this invention;

FIG. 2 is a partially sectioned view on 2—2 on FIG. 1;

FIG. 3 is a partially sectioned view on 3—3 on FIG. 1;

FIG. 4 is an enlarged exploded view of the area 50 on FIG. 1; and

FIG. 5 is a perspective of an alternate embodiment of a filter element of this invention.

DESCRIPTION OF A PREFERRED EMBODIMENT

The elements of the invention bearing reference numerals are:

| Numeral | Description |
|---|---|
| 10 | Mop bucket generally |
| 12 | mop bucket side |
| 14 | mop bucket front end |
| 15 | lip on front end |
| 16 | mop bucket side |
| 17 | drain |
| 18 | mop bucket back end |
| 19 | mop bucket bottom |
| 20 | wheels |
| 22 | brake |

-continued

| Numeral | Description |
|---|---|
| 30 | wringer generally |
| 31 | perforated front of wringer |
| 32 | wringer side |
| 32a | hanger hook |
| 33 | wringer side |
| 33a | hanger hook |
| 34 | wringer base plate |
| 35 | hinge |
| 36 | wringer squeeze plate |
| 37 | rib |
| 38 | rib |
| 39 | wringer support structure |
| 40 | foot treadle/wringer squeeze plate linkage |
| 40a | foot treadle/wringer squeeze plate linkage |
| 40b | foot treadle/wringer squeeze plate linkage |
| 41 | foot treadle |
| 42 | leaf spring |
| 44 | spring connection to bucket |
| 50 | linkage area 50 on FIG. 1 |
| 52 | boss |
| 52a | boss |
| 53 | threaded hole in boss |
| 54 | washer |
| 55 | hole in washer |
| 56 | linkage arm |
| 56a | linkage arm |
| 57 | hole in linkage arm |
| 58 | washer |
| 59 | hole in washer |
| 60 | bolt |
| 61 | bearing shoulder |
| 60a | bolt |
| 62 | threaded end of bolt |
| 64 | hole in arm 56 |
| 65 | keyway |
| 66 | linkage arm |
| 68 | boss |
| 69 | key |
| 72 | yoke |
| 74 | arm |
| 76 | pivot rod |
| 78 | dogleg arm |
| 79 | pivot connection to rib |
| 80 | filter generally |
| 81 | filter guide rib |
| 82 | filter guide rib |
| 83 | filter guide rib |
| 84 | filter guide rib |
| 86 | filter element |
| 90 | caddy |
| 91 | clip |
| 100 | alternate filter |
| 112 | filter panel |
| 114 | filter panel |
| 116 | frame |
| 116a | open frame edge |
| 117 | rubber rib |
| 118 | rubber rib |
| 122 | filter panel |
| 126 | frame |
| 127 | rubber rib |
| 128 | rubber rib |
| 130 | hard bar |
| 132 | thumb screw |
| 134 | threaded hole in frame |

FIGS. 1, 2, and 3 will best be viewed together. A bucket generally 10 is shown to consist of sides 12 and 16, front end 14, rear end 18 and bottom 19. This may be one piece construction, molded or otherwise formed by means known to those skilled in the art, or it may be fabricated from individual parts. One unique and inventive feature of the bucket shown is the lip 15 on front end 14. At present a particularly stressful task for one doing mopping is to dump dirty fluid from the bucket. This must be done periodically to provide clean mopping fluid. Usually the fluid is dumped into a basin or the like. This frequently causes undue stress and injuries I have solved that by the unique lip 15. The user needs only to lift, or even tilt, the bucket in such manner that the lip 15 hooks onto an edge of a basin. It is then a simple and less stressful matter to merely lift the bucket in a pivoting manner with the lip on the edge of the basin as the pivot point.

Mop buckets are commonly mounted on wheels. I have provided four wheels 20 in my new and unique mop bucket. The wheels are not unique, but I have provided brakes 22 on the two rear wheels. This is important and unique for any mop bucket, but it is a particularly important contribution to my overall new mop bucket since my mop wringer is foot operated. In any mopping activity it is sometimes a cause of mishaps when a mop bucket scoots away on its wheels. This can cause injury and strain.

The usual mop wringers heretofore known were all hand operated. They have consisted of perforated bucket-like members into which the mop is pressed or items like wringer 30 shown here except that the previously known ringers were hand operated. A plate similar to plate 36 in my new mop wringer was hand actuated by a lever and forced against a mop which in turn pressed against a perforated plate similar to plate 31 of my mop wringer. However, this causes stress and repetitive motion injuries. The same problem exists with mops which are pressed into a perforated bucket-like member.

The wringer 30 of my invention has sides 32 and 33, bottom base plate 34, hanger hooks 32*a* and 33*a*, ribs 37 and 38, and a support structure 39. I have conceived and perfected a unique foot treadle arrangement 41 through linkage 40/40*a*/40*b* to plate 36 which results in stress free foot actuated wringing.

Wringer plate 36 is hinged at 35 to wringer base plate 34. When foot treadle 41 is pressed down, arm 56 pivots on bolt 60 pulling down arm 66. Pivot rod 76 turns causing arm 78 pivotally connected at 79 to rib 33 to force pressure plate 36 toward perforated plate 31. If a mop is between the plates, this action wrings out the mop as will be understood by those skilled in the art. Fluid in the mop will fall into the bucket behind the filter 80. Leaf spring 42 connected to the bucket bottom at 44 by means known to those skilled returns the foot treadle and thus the plate 36 when pressure on the foot treadle is released.

The elements and their connection at area 50 will be understood by those skilled in the art on reviewing FIG. 4. Boss 52 is connected to bucket wall 12 by welding, adhesive, or in another manner known to those skilled in the art. Bolt 60 is inserted through hole 59 in washer 58, hole 57 in arm 56, and hole 55 in washer 54. The bearing shoulder 61 is the pivot member for arm 56. The threaded end 62 of bolt 60 is threaded into threaded hole 53 in boss 52. Arm 66 is connected to arm 56 by boss 68 with key 69 being inserted through hole 64 and keyway 65. The key then holds the two arms together during use. Arm 74 connects pivot rod 76 to yoke 72. When it is desired to move the wringer from the bucket, the arm 66 is disconnected at yoke 72. Arm 66 is then turned until the key 69 lines up with keyway 65. Arm 66 can then be completely removed allowing for free transport of the wringer. On side 16 of the bucket there will be a treadle linkage arm 56*a* similar to arm 56, bolt 60*a* similar to bolt 60, and boss 52*a* so that the treadle is supported on both sides.

I have added a drain 17 so that the bucket may be drained to a drain ditch or the like if desired. Also, I have added caddy 90 which clips to bucket side 16 by clips 91 in order to carry detergents, rags, and other desired items used in connection with mopping.

An important part of my invention is the insertion of a filter 80 intermediate the front and rear ends of the bucket. The filter is located so that it is between the front end of the bucket and the area where the dirty fluid drops into the bucket through holes 34 in plate 31 when the mop is squeezed against the plate 21 by action of the plate 36. The filter element 86 can be any filter screen which allows the free travel of fluid but which will inhibit travel of suspended particulate matter. Such filters are known to those skilled in the art. The filter screen is held in place as shown by filter ribs 81, 82, 83, and 84.

FIG. 5 shows an alternate, adjustable, filter 100 to be used with the mop bucket of this invention. FIG. 5 is an important sub-invention since it can provide a filter to be placed in any mop bucket without any special construction or alteration of the mop bucket. Two filter panels 112 and 114 are mounted at a spaced distance from one another in frame 116. The edge 116*a* will be open to allow filter panel 122 to telescope in and out of the space between panels 112 and 114. Filter panel 122 has a frame 126 completely surrounding it and a rigid bar 130 between the frame edges as indicated. In use, the filter panels 112–114 and 122 will be placed upright within mop bucket 10 or any other mop bucket. The panels will be extended until the rubber ribs 117 and 127 are securely pressing against the sides of the mop bucket and the ribs 118 and 128 are pressing against the bottom of the mop bucket. The thumb screw or the like 132 will be securely tightened against bar 130 through threaded hole 134 to hold the filter panels in place. Dirty cleaning fluid resulting from wringing a mop will thus be kept from clean fluid in order to enhance the mopping procedures.

While the embodiments of this invention shown and described are fully capable of achieving the objects and advantages desired, such embodiments have been shown for purposes of illustration only and not for purposes of limitation.

What is claimed is:

1. A wringer assembly comprising a bucket having: two flat sides, each of said flat sides has vertical filter holding ribs which hold a vertical, removable filter which divides the bucket into two compartments when said filter is held in place by said ribs in the bucket; a bottom; a flat front end with a curved, elongate lip extending over an entire top of the front end suitable to pivot on a basin edge; a back end; said assembly further comprising a wringer mounted upon and over the bucket adjacent the back end; and foot actuation means connected to said wringer.

* * * * *